US008177344B2

(12) United States Patent
Asada

(10) Patent No.: US 8,177,344 B2
(45) Date of Patent: May 15, 2012

(54) IMAGE RECORDING APPARATUS

(75) Inventor: Kazuhiko Asada, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 701 days.

(21) Appl. No.: 12/178,930

(22) Filed: Jul. 24, 2008

(65) Prior Publication Data

US 2009/0027461 A1 Jan. 29, 2009

(30) Foreign Application Priority Data

Jul. 27, 2007 (JP) ..... 2007-195758

(51) Int. Cl.
*B41J 2/18* (2006.01)

(52) U.S. Cl. ..... 347/89; 347/85

(58) Field of Classification Search ..... 347/85–89
See application file for complete search history.

(56) References Cited

U.S. PATENT DOCUMENTS 5,943,078 A * 8/1999 Nishimoto et al. ..... 347/89
6,082,851 A * 7/2000 Shihoh et al. ..... 347/85
6,817,705 B1 11/2004 Crockett et al.
2004/0141023 A1 7/2004 Nakamura
2005/0052513 A1 3/2005 Inoue
2006/0038862 A1 2/2006 Tanno

FOREIGN PATENT DOCUMENTS

EP 0 714 779 A 6/1996
EP 1 234 673 A 8/2002
JP 2006-327048 12/2006

OTHER PUBLICATIONS

European Search Report issued in Patent Application No. 08013013.1-1251 dated on Dec. 29, 2008.

* cited by examiner

*Primary Examiner* — Ellen Kim
(74) *Attorney, Agent, or Firm* — McDermott Will & Emery LLP

(57) ABSTRACT

An ink feeding mechanism includes an ink reservoir 31, a subtank 32 for temporarily storing ink, a decompression channel 44 for decompressing the subtank 32 to a fixed pressure, an ink force-feed channel 41 interconnecting the ink reservoir 31 and subtank 32, a first switch valve 35 mounted on the ink force-feed channel 41, a communication channel 43 interconnecting the subtank 32 and an inkjet head 10, an ink circulating channel 42 interconnecting the communication channel 43 and ink reservoir 31, and a second switch valve 34 mounted on the ink circulating channel 42. A lid member 51 forming part of a chamber has a pressure regulating channel 45 connected thereto, which is connected also to a force-feed channel 46 with a pressure pump 37 mounted thereon, and an exhaust channel 47 with an exhaust pump 38 mounted thereon.

8 Claims, 4 Drawing Sheets

IMAGE RECORDING APPARATUS

BACKGROUND OF THE INVENTION

1. Field of the Invention

This invention relates to an image recording apparatus which records an image on a recording medium by moving the recording medium and an inkjet head relative to each other.

2. Description of the Related Art

UV (ultraviolet) ink is used in the image recording apparatus which records an image on a recording medium by moving the recording medium and inkjet head relative to each other. The UV ink is also called an ultraviolet curable ink which contains, for example, pigment, a UV curable monomer and photoinitiator. The UV ink hardens by being irradiated with ultraviolet light from a UV lamp immediately after application to the recording medium. Therefore, by using such UV ink, it is possible to perform proper printing not only on ordinary paper, but also on a plastic film or the like which does not absorb ink.

Such UV ink may be white ink or an ink containing metal particles, which encounters a phenomenon of sedimentation in which pigment gathers vertically downward within the ink. When such sedimentation occurs, there is a possibility of causing a reduction in an inside diameter of a pipe due to adhesion of the pigment to inner walls of the pipe, resulting in a reduction in ink flow rate, clogging of the pipe and defective discharge from the inkjet head.

In the inkjet recording apparatus described in Japanese Unexamined Patent Publication No. 2006-327048, therefore, pigment sedimentation is prevented by circulating ink in a circulating pipe with a pump.

Generally, UV ink is highly corrosive. Therefore, the construction described in Japanese Unexamined Patent Publication No. 2006-327048 noted above must use an expensive, corrosion-resistant pump. This poses a problem that the entire apparatus becomes high-priced.

SUMMARY OF THE INVENTION

The object of this invention, therefore, is to provide an image recording apparatus having a simple construction for circulating ink, without using a pump, to be capable of preventing sedimentation of white pigment, metal particles and the like with a relatively large specific gravity among the components of the ink.

The above object is fulfilled, according to this invention, by an image recording apparatus for recording images on a recording medium by moving the recording medium and an inkjet head relative to each other, comprising an ink reservoir for storing ink; a subtank connected to the inkjet head for temporarily storing the ink to be discharged from the inkjet head; an ink force-feed channel interconnecting the ink reservoir and the subtank; a first switch valve mounted on the ink force-feed channel; an ink circulating channel interconnecting the ink reservoir and one of the inkjet head and the subtank; a second switch valve mounted on the ink circulating channel; a pressure regulating mechanism for pressurizing and decompressing the ink stored in the ink reservoir; and a controller for controlling the pressure regulating mechanism to pressurize the ink stored in the ink reservoir in a state where the first switch valve is opened and the second switch valve is closed, and to decompress the ink stored in the ink reservoir in a state where the first switch valve is closed and the second switch valve is opened.

With this image recording apparatus, sedimentation of white pigment, metal particles and the like contained in the ink can be prevented with a simple construction for circulating the ink without using a pump.

In a preferred embodiment, the image recording apparatus can prevent dripping of the ink when an image is not being recorded, thereby maintaining a proper state of image recording.

In another preferred embodiment, the image recording apparatus can circulate the ink by appropriately pressurizing and decompressing the ink stored in the ink reservoir.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
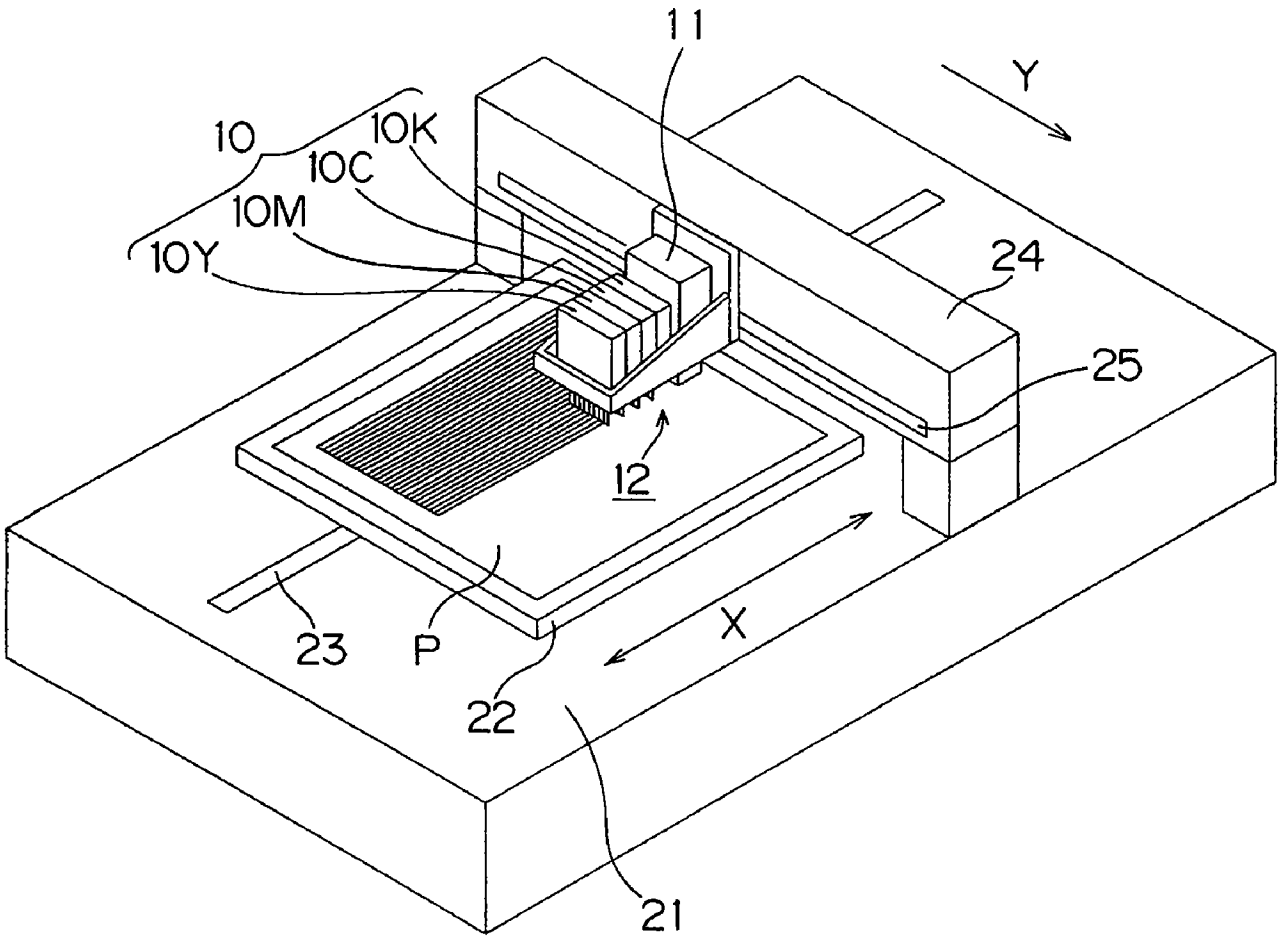
FIG. 1 is a perspective view of an image recording apparatus according to this invention.

An embodiment of this invention will be described hereinafter with reference to the drawings. FIG. 1 is a perspective view of an image recording apparatus according to this invention.

This image recording apparatus is constructed to record images with UV inks on a recording medium P. The apparatus includes a main body 21, a table 22 for supporting the recording medium P placed thereon and reciprocating on the main body 21 in the direction of X, a linear encoder 23 for measuring positions of the table 22 in the direction of X, a secondary axis frame 24 mounted on the main body 21, a recording head 12 having inkjet heads 10 and a UV lamp 11 and reciprocable on the secondary axis frame 24, and a linear encoder 25 for measuring positions of the recording head 12 in the direction of Y.

The inkjet heads 10 include a yellow inkjet head 10Y for discharging yellow UV ink, a magenta inkjet head 10M for discharging magenta UV ink, a cyan inkjet head 10C for discharging cyan UV ink, and a black inkjet head 10K for discharging black UV ink.

When recording an image with this image recording apparatus, the inks are discharged from the inkjet heads 10Y, 10M, 10C and 10K while moving the table 22 with the recording medium P placed thereon in the direction of X. The inks discharged from the inkjet heads 10Y, 10M, 10C and 10K and applied to the recording medium P are fixed thereto by being irradiated with ultraviolet light from the UV lamp 11. Once the table 22 has moved to a stroke end in the direction of X, the table 22 is moved in the opposite direction. The recording head 12 then is moved a minute distance in the direction of Y.

Thus, the image recording apparatus records an image on the recording medium P by reciprocating the recording medium P with the table 22 in a primary scanning direction (i.e. the direction of X in FIG. 1), and moving the recording head 12 intermittently in a secondary scanning direction (i.e. the direction of Y in FIG. 1).

Figure 2:
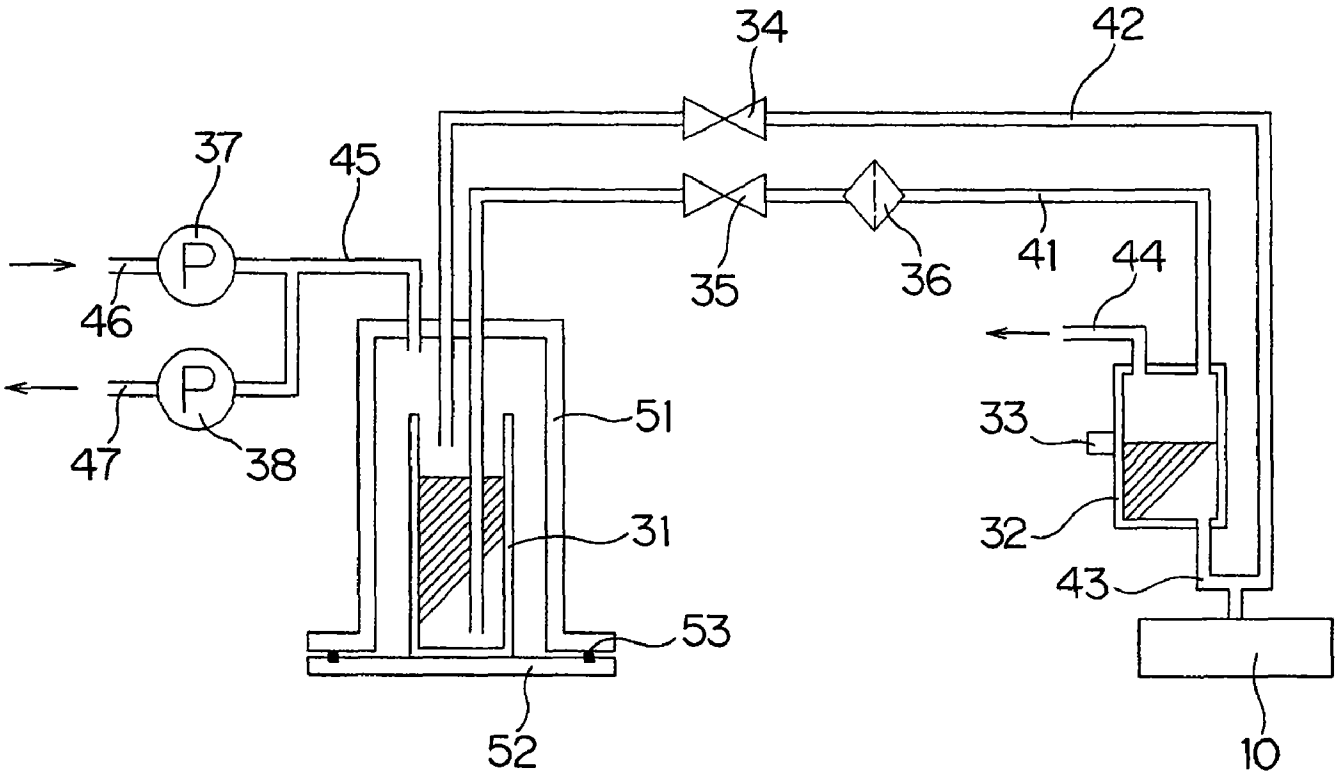
FIG. 2 is a schematic view of an ink feeding mechanism.
Figure 3:
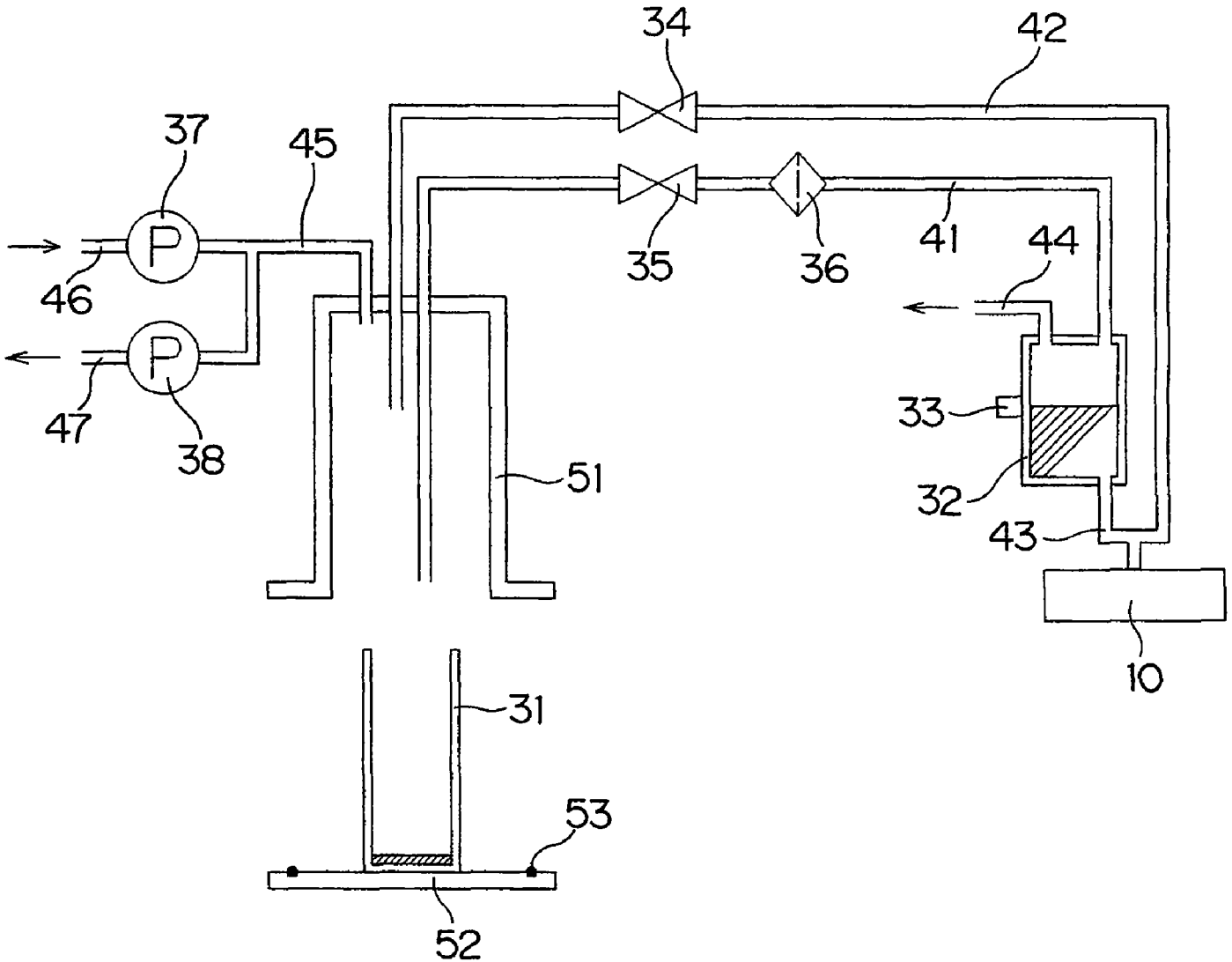
FIG. 3 is a schematic view of the ink feeding mechanism.

Next, an ink feeding mechanism forming the characterizing feature of this invention will be described. FIGS. 2 and 3 are schematic views of the ink feeding mechanism.

The ink feeding mechanism includes an ink reservoir 31 for storing ink, a subtank 32 connected to the inkjet head 10 for temporarily storing the ink to be discharged from the inkjet head 10, a decompression channel 44 for decompressing the subtank 32 to a certain fixed pressure, a sensor 33 for detecting the quantity of ink in the subtank 32, an ink force-feed channel 41 interconnecting the ink reservoir 31 and subtank 32, a first switch valve 35 and a filter 36 arranged on the ink force-feed channel 41, a communication channel 43 interconnecting the subtank 32 and inkjet head 10, an ink circulating channel 42 interconnecting the communication channel 43 and ink reservoir 31, and a second switch valve 34 mounted on the ink circulating channel 42.

The ink reservoir 31 is mounted in a chamber having a lid member 51, a table 52 vertically movable by a lift drive not shown, and an annular packing 53 disposed between the lid member 51 and table 52.

A pressure regulating channel 45 is connected to the lid member 51 of the chamber. The pressure regulating channel 45 is connected to a force-feed channel 46 with a pressure pump 37 mounted thereon, and to an exhaust channel 47 with an exhaust pump 38 mounted thereon. When the pressure pump 37 is driven, the atmosphere in the chamber is pressurized, whereby the ink stored in the ink reservoir 31 is pressurized. On the other hand, when the exhaust pump 38 is driven, the atmosphere in the chamber is decompressed, whereby the ink stored in the ink reservoir 31 is decompressed.

Figure 4:
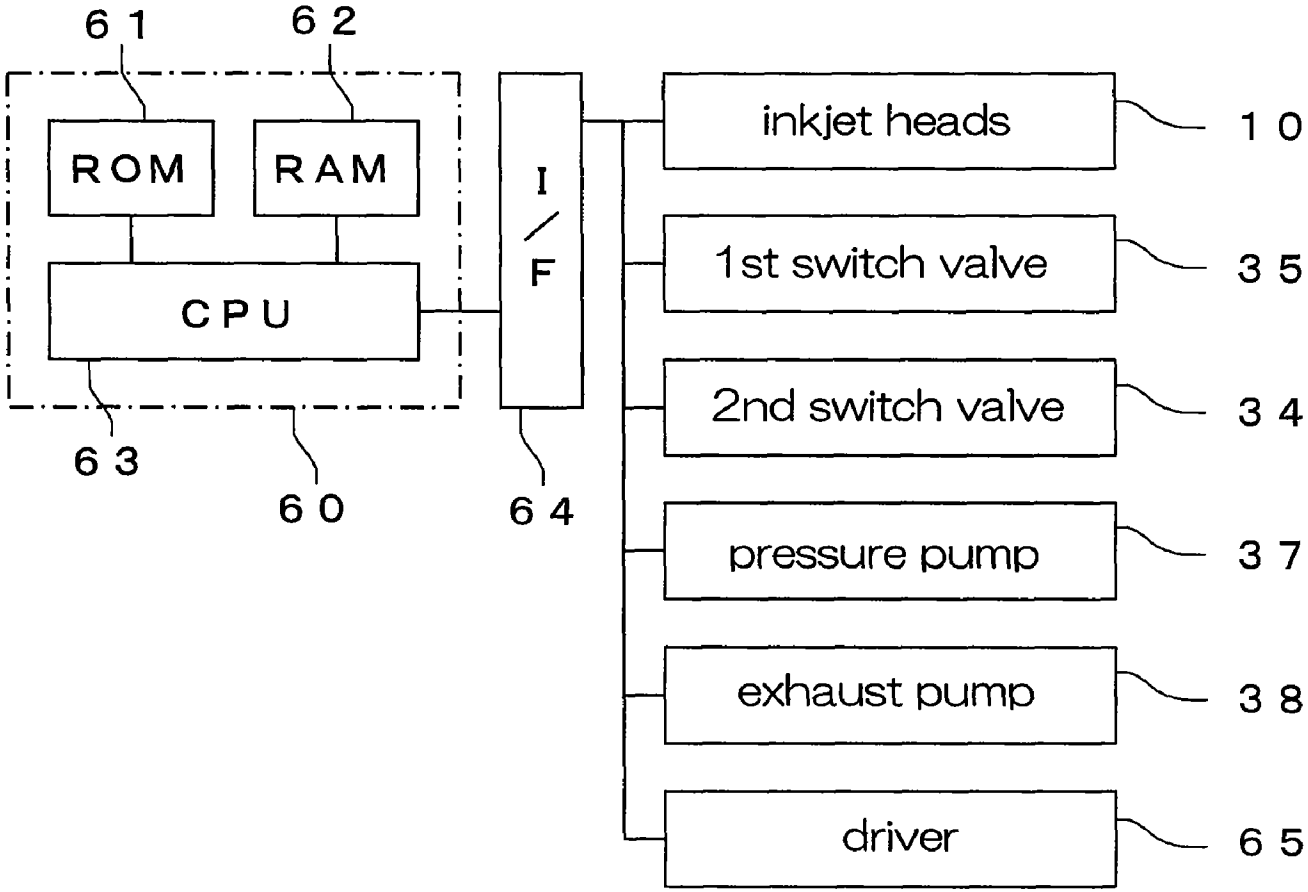
FIG. 4 is a block diagram showing a principal electrical structure of the image recording apparatus.

FIG. 4 is a block diagram showing a principal electrical structure of the above image recording apparatus.

The image recording apparatus includes a controller 60 having a ROM 61 storing an operating program necessary for control of the apparatus, a RAM 62 for temporarily storing data and the like at the time of control, and a CPU 63 for performing logical operations. The controller 60 is connected through an interface 64 to the inkjet head 10, first switch valve 35, second switch valve 34, pressure pump 37 and exhaust pump 38 noted above. The controller 60 is connected also to a driver 65 for driving each component of the image recording apparatus. The image recording apparatus is controlled by the controller 60 to perform various operations as described hereinafter.

With the image recording apparatus having the above construction, the first switch valve 35 and second switch valve 34 are closed during a normal image recording operation. In this state, as noted hereinbefore, the table 22 with a recording medium P placed thereon is moved in the direction of X, and the inks are discharged from the inkjet heads 10 by the action of piezo-electric elements arranged in the inkjet heads 10.

The interior of subtank 32 is constantly decompressed to the fixed pressure by the action of the decompression channel 44 connected to a decompression mechanism not shown. Therefore, when an image is not being recorded, the inks are prevented from dripping from ink outlets of the inkjet heads 10. At the same time, by concaving meniscuses in the ink outlets, it is possible to realize an improved effect of ink shutoff.

As ink is consumed and the sensor 33 detects that the quantity of ink in the subtank 32 falls below a fixed level, the first switch valve 35 is opened while the second switch valve 34 remains closed. In this state, the pressure pump 37 is driven to pressurize the chamber interior, thereby to pressurize the ink in the ink reservoir 31. As a result, the ink in the ink reservoir 31 is fed under pressure through the ink force-feed channel 41 to the subtank 32. When the sensor 33 detects that the quantity of ink in the subtank 32 has reached the fixed level, the pressure pump 37 is stopped and the first switch valve 35 and second switch valve 34 are closed.

When the ink in the ink reservoir 31 has been consumed in the course of continued operation to record images, as shown in FIG. 3, the table 52 is lowered by the lift drive not shown. After replacing the empty ink reservoir 31 with an ink reservoir 31 storing ink, as shown in FIG. 2, the table 52 is raised by the lift drive not shown.

Where, as described above, the construction is employed for placing the ink reservoir 31 in the chamber having the lid member 51, the table 52 vertically movable by the lift drive not shown, and the annular packing 53 disposed between the lid member 51 and table 52, the ink reservoir 31 used may have any arbitrary shape. It is thus possible to use ink reservoirs generally available in the market.

When the apparatus is not used in image recording, a sedimentation preventing operation is carried out to circulate the ink in order to prevent sedimentation of white pigment, metal particles and the like contained in the ink. This sedimentation preventing operation is performed at fixed time intervals.

When performing the sedimentation preventing operation, the second switch valve 34 is opened and the first switch valve 35 closed. In this state, the exhaust pump 38 is driven to decompress the chamber interior, thereby to decompress the ink in the ink reservoir 31. As a result, the ink in the subtank 32 is drawn into the ink reservoir 31 through the ink circulating channel 42.

When, in this state, the sensor 33 detects that the quantity of ink in the subtank 32 has fallen to a fixed level, the second switch valve 34 is closed and the first switch valve 35 is opened. Then, the pressure pump 37 is driven to pressurize the chamber interior, thereby to pressurize the ink in the ink reservoir 31. As a result, the ink in the ink reservoir 31 is force-fed into the subtank 32 through the ink force-feed channel 41.

When the sensor 33 detects that the quantity of ink in the subtank 32 has reached a fixed level, the second switch valve 34 is opened and the first switch valve 35 is closed again. In this state, the exhaust pump 38 is driven to decompress the chamber interior, thereby to decompress the ink in the ink reservoir 31. As a result, the ink in the subtank 32 is drawn into the ink reservoir 31 through the ink circulating channel 42.

By repeating the above operation a plurality of times, the ink is recirculated to prevent sedimentation of white pigment, metal particles and the like contained in the ink.

The image recording apparatus having the described construction can also perform an operation for degassing the ink in the ink reservoir 31. When performing the ink deaerating operation, the first switch valve 35 and second switch valve 34 are closed, and the exhaust pump 38 is driven to decompress the chamber interior, thereby to decompress the ink in the ink reservoir 31. This state is maintained for a fixed time, which accomplishes degassing of the ink in the ink reservoir 31.

In the embodiment described above, the ink circulating channel 42 is connected to the communication channel 43 interconnecting the subtank 32 and inkjet head 10. Thus, the ink circulating channel 42 is connected to the inkjet head 10 and subtank 32 through the communication channel 43. However, the ink circulating channel 42 may be connected to either the inkjet head 10 or the subtank 32.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2007-195758 filed in the Japanese Patent Office on Jul. 27, 2007, the entire disclosure of which is incorporated herein by reference.

What is claimed is:

1. An image recording apparatus for recording images on a recording medium by moving the recording medium and an inkjet head relative to each other, comprising:

an ink reservoir for storing ink;

a subtank connected to said inkjet head for temporarily storing the ink to be discharged from said inkjet head;

an ink force-feed channel interconnecting said ink reservoir and said subtank;

a first switch valve mounted on said ink force-feed channel;

an ink circulating channel interconnecting said ink reservoir and one of said inkjet head and said subtank;

a second switch valve mounted on said ink circulating channel;

a pressure regulating mechanism for pressurizing and decompressing the ink stored in said ink reservoir; and a controller comprising a processor and a memory having a program, when executed, causing the processor to control, for preventing sedimentation of components of the ink in the ink circulating channel, said pressure regulating mechanism to, at fixed time intervals, pressurize the ink stored in said ink reservoir in a state where said first switch valve is opened and said second switch valve is closed, and to decompress the ink stored in said ink reservoir in a state where said first switch valve is closed and said second switch valve is opened.

2. An image recording apparatus as defined in claim 1, wherein said pressure regulating mechanism includes a pressure pump for pressurizing the ink stored in said ink reservoir, and an exhaust pump for decompressing the ink stored in said ink reservoir.

3. An image recording apparatus as defined in claim 2, further comprising:

a chamber for enclosing said ink reservoir;

wherein said pressure pump is arranged to pressurize an atmosphere in said chamber, and said exhaust pump is arranged to exhaust the atmosphere from said chamber.

4. An image recording apparatus as defined in claim 1, wherein the ink is a UV ink including pigment and a UV-curable monomer.

5. An image recording apparatus for recording images on a recording medium by moving the recording medium and an inkjet head relative to each other, comprising:

an ink reservoir for storing ink;

a subtank connected to said inkjet head for temporarily storing the ink to be discharged from said inkjet head;

a decompressing device for decompressing said subtank;

an ink force-feed channel interconnecting said ink reservoir and said subtank;

a first switch valve mounted on said ink force-feed channel;

an ink circulating channel interconnecting said ink reservoir and one of said inkjet head and said subtank;

a second switch valve mounted on said ink circulating channel;

a pressure regulating mechanism for pressurizing and decompressing the ink stored in said ink reservoir; and a controller comprising a processor and a memory having a program, when executed, causing the processor to control, for preventing sedimentation of components of the ink in the ink circulating channel, said pressure regulating mechanism to, at fixed time intervals, pressurize the ink stored in said ink reservoir in a state where said first switch valve is opened and said second switch valve is closed, and to decompress the ink stored in said ink reservoir in a state where said first switch valve is closed and said second switch valve is opened.

6. An image recording apparatus as defined in claim 5, wherein said pressure regulating mechanism includes a pressure pump for pressurizing the ink stored in said ink reservoir, and an exhaust pump for decompressing the ink stored in said ink reservoir.

7. An image recording apparatus as defined in claim 6, further comprising:

a chamber for enclosing said ink reservoir;

wherein said pressure pump is arranged to pressurize an atmosphere in said chamber, and said exhaust pump is arranged to exhaust the atmosphere from said chamber.

8. An image recording apparatus as defined in claim 5, wherein the ink is a UV ink including pigment and a UV-curable monomer.

* * * * *